US006977583B2

(12) United States Patent
Gornick

(10) Patent No.: US 6,977,583 B2
(45) Date of Patent: Dec. 20, 2005

(54) AUTOMATIC RESET OF LUBRICATING FLUID LIFE MONITORING SYSTEM

(75) Inventor: Henry William Gornick, Shelby Township, MI (US)

(73) Assignee: General Motors Corporation, Detroit, MI (US)

( * ) Notice: Subject to any disclaimer, the term of this patent is extended or adjusted under 35 U.S.C. 154(b) by 54 days.

(21) Appl. No.: 10/659,612

(22) Filed: Sep. 9, 2003

(65) Prior Publication Data

US 2005/0062596 A1 Mar. 24, 2005

(51) Int. Cl.[7] ..... B01D 35/143
(52) U.S. Cl. ..... 340/457.4; 340/450.3; 340/451; 340/457; 702/184; 123/196 S
(58) Field of Search ..... 340/457.4, 451, 340/606, 607, 611; 701/30; 123/196 S; 702/184

(56) References Cited

U.S. PATENT DOCUMENTS

| | | | | |
|---|---|---|---|---|
| 4,500,874 | A * | 2/1985 | Jacobi et al. | 340/607 |
| 5,092,429 | A * | 3/1992 | Linares et al. | 184/1.5 |
| 6,172,602 | B1 * | 1/2001 | Hasfjord | 340/438 |
| 6,208,245 | B1 * | 3/2001 | Post et al. | 340/457 |
| 6,474,289 | B1 * | 11/2002 | Lilly et al. | 123/198 D |
| 6,484,127 | B1 * | 11/2002 | Langervik | 702/184 |
| 6,513,368 | B2 * | 2/2003 | Bondarowicz et al. | 73/53.05 |
| 6,614,345 | B2 * | 9/2003 | Kimata et al. | 340/450.3 |
| 6,711,525 | B1 * | 3/2004 | Fox et al. | 702/184 |

* cited by examiner

*Primary Examiner*—Jeffery Hofsass
*Assistant Examiner*—Anne V. Lai
(74) *Attorney, Agent, or Firm*—Christopher DeVries

(57) ABSTRACT

The fluid life monitoring system of the present invention includes a pressure monitor coupled to an engine. The pressure monitor is configured to detect a change in the amount of time it takes the engine's lubricating fluid to reach a pre-determined fluid pressure and, based on a detected change, reset the fluid life monitoring system.

20 Claims, 2 Drawing Sheets

AUTOMATIC RESET OF LUBRICATING FLUID LIFE MONITORING SYSTEM

TECHNICAL FIELD

The present invention relates generally to engines and more particularly to a lubrication fluid monitoring system for engines.

BACKGROUND ART

As most vehicle owners know, engine-lubricating fluid plays an important role in the proper operation of a vehicle engine. Not only does the lubricating fluid provide lubrication for the valves and other moving parts in the engine, it also helps to dissipate the heat generated by the engine and also cleans moving engine parts. Excessive heat and certain impurities found in many engines may cause the lubricating fluid, and the additives typically contained in the lubricating fluid, to become dirty and to start to break down, resulting in reduced lubrication and cleaning ability. Accordingly, it is considered very desirable to periodically change the lubricating fluid in order to maintain proper engine operation.

Suggested engine lubricating fluid change intervals vary depending primarily on the manner in which the vehicle is driven and the environmental conditions under which the vehicle is driven. Additionally, most engine manufacturers will generally recommend appropriate intervals for replacing the engine lubricating fluid for their specific engines. In order to maintain proper engine operation and reduce the likelihood of engine failure, most vehicle owners follow the recommended guidelines and replace the engine lubricating fluid on a periodic basis. In order to remind the vehicle operator of the need to periodically change the engine lubricating fluid, most manufacturers will provide a visual reminder to the owner/operator, such as a lighted icon or message displayed on a control panel or dashboard.

In order to accurately determine when to change the lubricating fluid for a given engine, the vehicle's engine control module (ECM) will typically monitor the operating conditions of the engine and, based on the expected "fluid life" of the lubricating fluid, activate the visual reminder to change the lubricating fluid after the appropriate interval. The interval for changing the fluid is typically based on parameters such as the number of miles the car has traveled since the last lubricating fluid change, the number of times the engine has been started, the number of cylinder firings, the average operating temperature of the engine, etc. Once the expected fluid life has been reached, the indicator will be activated and the vehicle can be serviced. Then, once the engine lubricating fluid has been replaced, the service technician will manually reset the fluid life monitoring system within the ECM to indicate the start of a new operational period for the new lubricating fluid.

While the current fluid life monitoring systems have been somewhat successful, there are some concerns that remain to be addressed. For example, some vehicle owner/operators may simply forget or neglect to change the lubricating fluid at the appropriate time, even if the change fluid indicator is activated. Additionally, some leased vehicles, especially when leased for a short period of time, may be operated for extended periods of time without the proper maintenance, including recommended fluid changes. Further, some owners may try to reduce the short-term operational costs associated with their vehicle by running the engine beyond the recommended intervals without changing the lubricating fluid in the engine. In any of these situations, the owner/operator can simply choose to manually reset the fluid life monitoring system and continue driving the vehicle without actually changing the lubricating fluid. This, in turn, may lead to premature wear of the engine's components and may result in less than optimal engine performance.

The issue of compliance with the manufacturer's recommended fluid change procedures can become an issue when the engine performance deteriorates and the responsibilities of the manufacturer under the engine warranty are considered. For example, if a vehicle's owner/operator has not replaced the engine lubricant at the manufacturer's recommended intervals, undue engine wear and possible damage may be directly related to the operator's failure to change the lubricating fluid and not due to the normal operational wear associated with the engine or manufacturing defects.

While the manufacturer may not be contractually required to repair or replace an improperly maintained engine, it can be very difficult, if not impossible, for the manufacturer to determine if the engine has been serviced in accordance with the appropriate guidelines. Since the fluid life monitoring system is relatively simple to reset, there is no guarantee that the lubricating fluid has actually been changed. The result is that, in certain circumstances, the manufacturer may be required to repair or replace engines and/or related components when the vehicle owner/operator, not the engine, is really the source of the problem.

In view of the foregoing, it should be appreciated that it would be desirable to provide methods and apparatus for more reliably monitoring and capturing information relative to the frequency of change for the engine lubricating fluid. Furthermore, additional desirable features will become apparent to one skilled in the art from the foregoing background of the invention and following detailed description of a preferred exemplary embodiment and appended claims.

SUMMARY OF THE INVENTION

A fluid monitoring system for an engine containing a lubricating fluid is provided in accordance with the present invention. The fluid monitoring system includes a pressure monitor coupled to the engine that is configured to provide an indication of a fluid pressure. The fluid monitoring system also includes an engine control module configured to receive the indication of the fluid pressure, monitor changes in the fluid pressure over a time period following startup of the engine, detect a change in an amount of time for the fluid to reach a pre-determined fluid pressure, and reset the fluid monitoring system in response to the change in the amount of time.

A method of detecting a filter change in an engine is provided in accordance with the present invention. The method includes the steps of monitoring a fluid pressure in the engine following startup of the engine, detecting a change in an amount of time required for the fluid pressure to reach a pre-determined level and resetting a fluid life monitoring system based on the change in the amount of time for the fluid pressure to reach a pre-determined level.

BRIEF DESCRIPTION OF THE DRAWINGS

The preferred exemplary embodiments of the present invention will hereinafter be described in conjunction with the appended drawings, where like designations denote like elements, and.

DETAILED DESCRIPTION OF THE PREFERRED EMBODIMENTS

Figure 1:
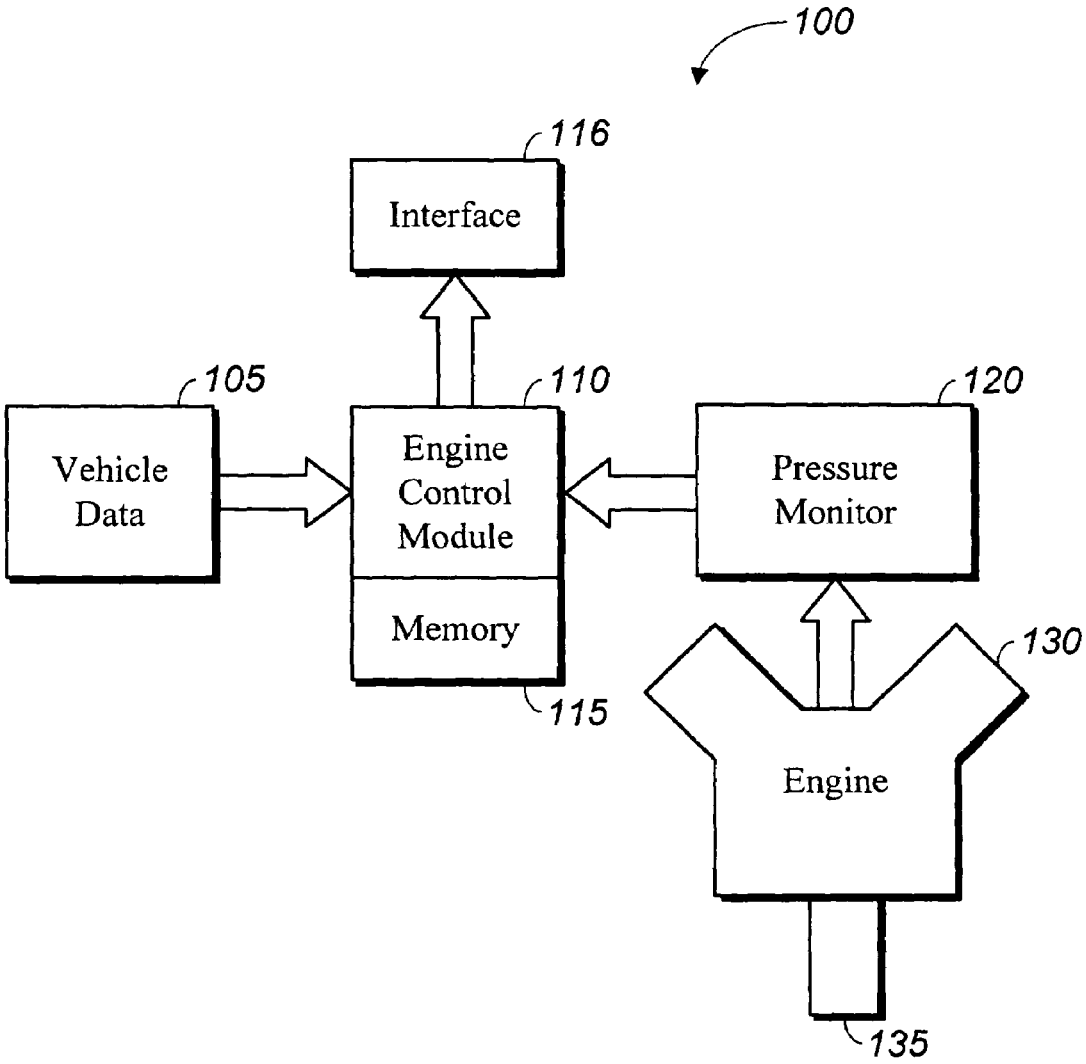
FIG. 1 is a schematic block diagram of a fluid life monitoring system in accordance with a preferred exemplary embodiment of the present invention.

Referring now to FIG. 1, a fluid life monitoring system 100 in accordance with a preferred exemplary embodiment of the present invention includes a vehicle data module 105, an Engine Control Module (ECM) 110, an interface 116, a pressure monitor 120, and an engine 130. ECM 110 includes a memory 115 and engine 130 includes a replaceable filter 135.

Engine 130 may be any type of fluid-lubricated engine with an attached filter known to those skilled in the art. Filter 135 is typically coupled to engine 130 and is installed in a threaded opening leading into the housing of engine 130. Filter 135 is most preferably removable and replaceable, at intervals directed by the manufacturer of engine 130. In the most preferred embodiments of the present invention, engine 130 is any typical oil lubricated internal combustion engine used in a standard vehicle such as a passenger car, sport utility vehicle, or truck.

ECM 110 is typically a microprocessor-based device that controls various operations associated with engine 130. For example, ECM 110 may determine the beginning and end of each fuel injection cycle for the cylinders in engine 130. Additionally, ECM 110 may determine both fuel metering and injection timing in response to such parameters as engine crankshaft position and rpm, engine coolant and intake air temperature, and absolute intake air boost pressure. ECM 110 also receives additional information related to the vehicle containing fluid life monitoring system 110 from vehicle data module 105 and can store and retrieve this information using memory 115. It should be noted that the fluid life monitoring functions associated with ECM 110 in the preferred exemplary embodiments of the present invention might be performed by other devices associated with the vehicle as well. Reference is made to ECM 110 for purposes of explanation only and the control and reporting functions of fluid life monitoring system 100 may be implemented in other ways well known to those skilled in the art.

Memory 115 is any type of suitable memory device known to those skilled in the art. In the most preferred embodiments of the present invention, memory 115 is a non-volatile random access memory chip, coupled to the microprocessor in ECM 110. While shown as a separate memory device, in the most preferred embodiments of the present invention, memory 115 may be integrated into ECM 110. Accordingly, memory 115 is any memory location within the address space of ECM 110, regardless of its physical location. Specifically, memory 115 may be implemented as a single integrated memory module or as a number of separate components, each with a discrete memory location.

Vehicle data module 105 is coupled to ECM 110. Vehicle data module 105 is configured to supply at least one data element to ECM 110. It should be noted that vehicle data module 105 is merely representative of the numerous sensors and indicators that monitor and report various data elements associated with the vehicle containing fluid life monitoring system 100. Examples include accelerometer data, odometer data, system fault signals, etc. Vehicle data module 105 may be implemented as a single module or a plurality of discrete modules. The information provided by vehicle data module 105 can be used in conjunction with the pressure data provided by pressure monitor 120 to enhance the capabilities of fluid life monitoring system 100.

Pressure monitor 120 is coupled to ECM 110 and engine 130. In the most preferred embodiments of the present invention, pressure monitor 120 is any suitable monitoring device capable of monitoring and reporting the level of fluid pressure within engine 130. Pressure monitor 120 is configured to monitor the fluid pressure in engine 130 and detect a change in the amount of time it takes the fluid in engine 130 to reach the appropriate pre-determined level. The pressure information gathered by pressure monitor 120 may be relayed to ECM 110 and, in the most preferred embodiments of the present invention, stored in memory 115. Those skilled in the art will recognize that although pressure monitor 120 is shown as a discrete component, it may be integrated into another component, such as ECM 110.

During normal operation for a typical internal combustion engine, such as engine 130, it takes a relatively short period of time after ignition, approximately one or two seconds, for the lubricating fluid inside engine 130 to reach the desired operating pressure. However, whenever the lubricating fluid is drained from engine 130 and filter 135 is replaced, it will generally take substantially more time for engine 130 to generate the appropriate level of fluid pressure after ignition. Once again, referencing a typical internal combustion engine, this time period may be as long as 20 seconds or more.

The reason why it takes a relatively longer time period to reach the appropriate operational pressure level for engine 130 is directly related to the replacement of filter 135. Specifically, after replacement, new filter 135 must be filled with engine lubricating fluid. The time that it takes engine 130 to reach the appropriate operational pressure level after a change of lubricating fluid is closely related to the amount of time it takes to fill filter 135. In either case, pressure monitor 120 monitors the amount of time that it takes the lubrication fluid in engine 130 to reach the desired operational pressure level and then reports this information back to ECM 110. The actual amount of time required to reach the desired operational pressure in engine 130 as reported by pressure monitor 120 can be compared to a table of calibrated values by ECM 110.

Since the amount of time required to reach the desired pressure after a fluid change is relatively long when compared to the normal time period for reaching the appropriate pressure level, this time difference can be used to trigger a reset of fluid life monitoring system 100. Accordingly, after a change of lubricating fluid, ECM 110 can access the appropriate location in memory 115 where the fluid life monitoring flag is stored and reset it to indicate the lubricating fluid replacement. This event may also be used in conjunction with the data elements supplied by vehicle data module 105 to enhance the functionality of fluid life monitoring system 100. For example, the information relative to the frequency of fluid changes for engine 130 may be stored in memory 115 and, along with odometer data received from vehicle data module 105, may be used to provide a fluid change history report, correlated with vehicle mileage at the time of each fluid change.

In another preferred embodiment of the present invention, ECM 110 will repeatedly store a value representing the length of time required to reach the desired fluid pressure level for each engine start. After a predetermined number of engines starts, the average time required to reach the desired fluid pressure level can be determined and stored in memory 115. From that point forward, the length of time required to reach the desired fluid pressure level for each subsequent engine start can be compared to the average time stored in memory 115. If the actual time varies from the average time by a pre-determined statistically significant amount, then ECM 110 will infer a fluid change and reset fluid life monitoring system 100. In this fashion, ECM 110 can adaptively "learn" to reset fluid life monitoring system 100 over time and adjust the reset point in accordance with actual vehicle operating parameters.

Interface 116 is coupled to ECM 110 and provides a physical connection to other internal vehicle systems or external systems. ECM 110 can utilize interface 116 to report various types of information to external systems and to provide various signals for indicating the occurrence or non-occurrence of a fluid change. For example, interface 116 may be connected to an external diagnostic computer and information regarding fluid changes may be transferred from ECM 110 and/or memory 115 to the external diagnostic machine. In this fashion, the manufacturer of engine 130 can determine whether or not engine 130 has been serviced in accordance with the manufacturer's recommendations. This information can be used to make warranty authorization decisions when repairs are necessary. Additionally, interface 116 may be connected to one or more audio or visual indicators that can alert the driver of the need to replace the lubricating fluid in engine 130.

Figure 2:
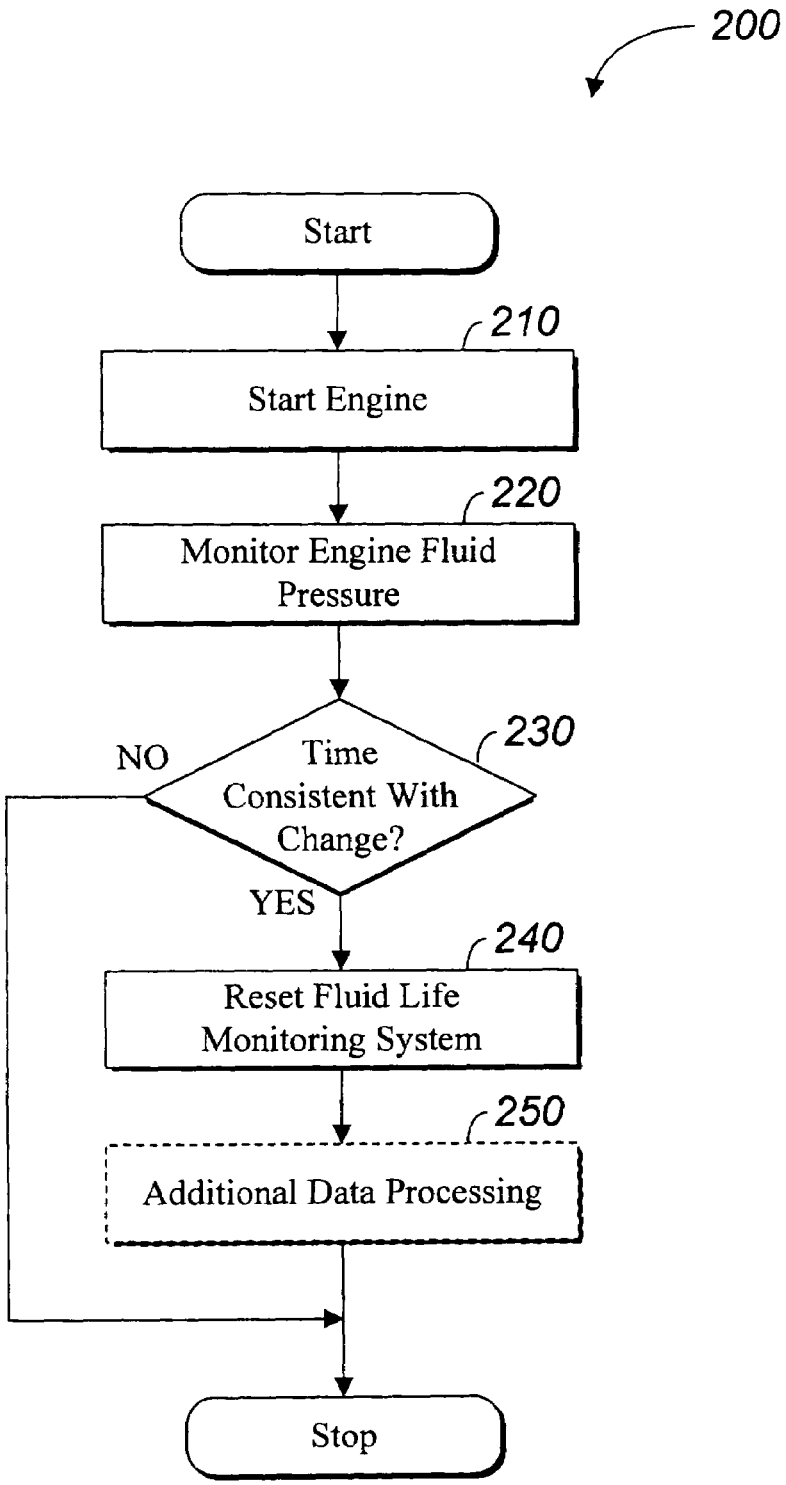
FIG. 2 is a flow diagram illustrating the operation of a fluid life monitoring system in accordance with a preferred exemplary embodiment of the present invention.

Referring now to FIG. 2, a flow diagram 200 describing the operation of a fluid life monitoring system in accordance with a preferred embodiment of the present invention is shown. Each time the lubricated engine is started (step 210), the pressure inside the engine is monitored by a pressure monitor (step 220) until it reaches the desired operational level. The actual length of time it takes to reach the appropriate pressure level is evaluated (step 230) and compared to the expected length of time for the fluid to reach the predetermined pressure level. If the actual length of time is not consistent with the expected length of time for the pressure to reach the appropriate level after a lubricating fluid change (step 230="NO"), then the fluid life monitoring system is not reset and the process will be repeated the next time the engine is started.

However, if the actual length of time is consistent with the expected length of time required for the pressure to reach the appropriate level after a lubricating fluid change (step 230="YES"), then the fluid life monitoring system is reset to indicate the fluid change. In at least one preferred embodiment of the present invention, after the fluid life monitoring system has been reset, additional data processing is performed (step 250). Examples of optional data processing may include storing information related to the fluid change in a memory location and preparing correlated data for later dissemination. It may be desirable to store the mileage of the vehicle of the lubricating fluid change or the date of the lubricating fluid change in memory 115 or some other location. Similarly, it may be desired to activate some other internal or external system based on the replacement of the lubricating fluid, using interface 116. This may include the use of a visual indicator to indicate the occurrence or non-occurrence of the fluid change.

While certain elements have been presented in the foregoing detailed description, it should be appreciated that a vast number of variations in the embodiments exist. It should also be appreciated that the exemplary embodiments are only examples, and are not intended to limit the scope, applicability, or configuration of the invention in any way. Rather, the foregoing detailed description provides those skilled in the art with a convenient road map for implementing the exemplary embodiments of the invention. It should also be understood that various changes may be made in the function and arrangement of elements described in the exemplary preferred embodiments without departing from the spirit and scope of the invention as set forth in the appended claims.

What is claimed is:

1. A method of detecting a filter change in an engine, the method comprising the steps of:

determining an average time for a fluid pressure in said engine to reach a predetermined level following startup of the engine;

detecting an amount of time for the fluid pressure to reach the pre-determined level; and resetting a fluid life monitoring system if the amount of time for the fluid pressure to reach a pre-determined level varies from the average time by a pre-determined amount.

2. The method of claim 1 wherein said step of resetting said fluid life monitoring system comprises the step of setting a flag in a memory location.

3. The method of claim 1 further comprising the step of performing additional data processing after detecting said amount of time for said fluid pressure to reach a pre-determined level.

4. The method of claim 1 further comprising the step of storing at least one data element related to said change in the amount of time for said fluid pressure to reach the pre-determined level.

5. The method of claim 4 wherein said step of storing at least one data element related to said change in the amount of time for said fluid pressure to reach-currently amended pre-determined level comprises the step of storing an odometer reading in said memory location.

6. The method of claim 4 wherein said step of storing at least one data element related to said change hi the amount of time for said fluid pressure to reach the pre-determined level in a memory location comprises the step of storing a date in said memory location.

7. The method of claim 4 wherein said step of storing at least one data element related to said change in the amount of time for said fluid pressure to reach the pre-determined level in a memory location comprises the step of storing an odometer reading and a date in said memory location.

8. The method of claim 1 wherein the resetting step comprises resetting the fluid life monitoring system if the amount of time exceeds a threshold period of time.

9. A fluid monitoring system for an engine containing a lubricating fluid, the fluid monitoring system comprising:

a pressure monitor coupled to said engine configured to provide an indication of a fluid pressure;

an engine control module configured to receive the indication of the fluid pressure, to determine an average value for the fluid pressure over a time period following startup of the engine, to detect a change in an amount of time for said fluid to reach a pre-determined fluid pressure from the average value, and to reset the fluid monitoring system in response to the change in the amount of time.

10. The fluid monitoring system of claim 9 wherein said engine control module is further configured to set a flag after detecting said change in the amount of time for said lubricating fluid to reach a pre-determined fluid pressure.

11. The fluid monitoring system of claim 10 wherein said flag comprises a memory location in the engine control module.

12. The fluid monitoring system of claim 9 further comprising a vehicle data module coupled to said engine control module, said vehicle data module being configured to supply at least one data element to said engine control module.

13. The fluid monitoring system of claim 9 further comprising an interface coupled to said engine control module, said interface being configured to provide at least one signal for indicating the need for replacing said lubricating fluid.

14. The fluid monitoring system of claim 9 further comprising:

an engine control module coupled to said pressure monitor;

a vehicle data module coupled to said engine control module, said vehicle data module being configured to supply at least one data element to said engine control module; and an interface coupled to said engine control module, said interface being configured to provide at least one signal for indicating the need for replacing said lubricating fluid.

15. The fluid monitoring system of claim 14 wherein said engine control module comprises a memory, said memory being configured to store at least one data element associated with replacing said lubricating fluid.

16. A method of resetting a fluid life monitoring system in an engine, the method comprising the steps of:

determining an average time for a fluid pressure in said engine to reach a predetermined level following startup of the engine;

evaluating the actual length of time for said fluid pressure to reach the pre-determined level;

comparing said actual length of time to the average length of time;

setting a flag in a first memory location, based on a difference between said actual length of time and said average length of time, thereby resetting a fluid life monitoring system; and storing at least one data element related to said difference between said actual length of time and said average length of time in a second memory location.

17. The method of claim 16 wherein step of storing at least one data element related to said difference between said actual length of time and said average length of time in a second memory location comprises the step of storing an odometer reading in said second memory location.

18. The method of claim 16 wherein step of storing at least one data element related to said difference between said actual length of time and said average length of time in a second memory location comprises the step of storing a date in said second memory location.

19. The method of claim 16 further comprising the step of providing a fluid change history report.

20. A digital storage medium having computer-executable instructions stored thereon, the instructions comprising:

a first module configured to determine an amount of time for a fluid pressure in an engine to reach a predetermined level following startup of the engine;

a second module configured to determine an average time for a fluid pressure in said engine to reach a predetermined level following startup of the engine; and a third module configured to reset a fluid life monitoring system if the amount of time for the fluid pressure to reach a pre-determined level varies from the average time by a pre-determined amount.

* * * * *